US006003857A

United States Patent [19]

Salomon et al.

[11] Patent Number: 6,003,857

[45] Date of Patent: Dec. 21, 1999

[54] SINGULATING APPARATUS FOR A MAIL HANDLING SYSTEM

[75] Inventors: James Salomon, Cheshire, Conn.; Dennis C. Inglesias, Portsmouth, R.I.; Robert P. Rebres, Seymour; Anthony E. Yap, Danbury, both of Conn.

[73] Assignee: Pitney Bowes Inc., Stamford, Conn.

[21] Appl. No.: 08/943,407

[22] Filed: Oct. 3, 1997

[51] Int. Cl.[6] ..... B65H 1/08; B65H 1/02; B65H 3/52; B65H 2/02

[52] U.S. Cl. ..... 271/122; 271/126; 271/150; 271/258.02

[58] Field of Search ..... 271/110, 122, 271/126, 147, 149, 150, 258.02

[56] References Cited

U.S. PATENT DOCUMENTS

| | | | |
|---|---|---|---|
| 4,893,804 | 1/1990 | Sasage et al. | 271/3.1 X |
| 4,909,499 | 3/1990 | O'Brien, et al. . | |
| 4,978,114 | 12/1990 | Holbrook . | |
| 4,995,596 | 9/1991 | Riddiardi | 271/110 |
| 5,074,540 | 12/1991 | Belec et al. . | |
| 5,238,236 | 8/1993 | Belec et al. . | |
| 5,431,385 | 7/1995 | Holbrook | 271/122 |
| 5,449,162 | 9/1995 | Saito et al. | 271/122 |

*Primary Examiner*—William E. Terrell
*Assistant Examiner*—Kenneth Bower
*Attorney, Agent, or Firm*—Steven J. Shapiro; Michael E. Melton

[57] ABSTRACT

A singulator apparatus includes a forwardly driving device and a reverse driving mechanism which operate together to separate individual articles from a stack of articles being transported thereto from an upstream feeding device. The singulator further includes a sensor which detects the presence of articles at the articles ingestion nip defined between the forwardly driving device and the reverse driving mechanism. A controller stops operation of the feeding device upon detection of the presence of articles by the sensor and initiate feeding by the feeding device if no articles are sensed by the sensor.

10 Claims, 8 Drawing Sheets

SINGULATING APPARATUS FOR A MAIL HANDLING SYSTEM

BACKGROUND

The processing and handling of mailpieces consumes an enormous amount of human and financial resources, particularly if the processing of the mailpieces is done manually. The processing and handling of mailpieces not only takes place at the Postal Service, but also occurs at each and every business or other site where communication via the mail delivery system is utilized. That is, various pieces of mail generated by a plurality of departments and individuals within a company need to be collected, sorted, addressed, and franked as part of the outgoing mail process. Additionally, incoming mail needs to be collected and sorted efficiently to ensure that it gets to the addressee in a minimal amount of time. Since much of the documentation and information being conveyed through the mail system is critical in nature relative to the success of a business, it is imperative that the processing and handling of both the incoming and outgoing mailpieces be done efficiently and reliably so as not to negatively impact the functioning of the business.

In view of the above, various automated mail handling machines have been developed for processing mail (removing individual pieces of mail from a stack and performing subsequent actions on each individual piece of mail). However, in order for these automatic mail handling machines to be effective, they must process and handle "mixed mail." The term "mixed mail" is used herein to mean sets of intermixed mailpieces of varying size (postcards to 9" by 12" flats), thickness, and weight. In addition, the term "mixed mail" also includes stepped mail (i.e. an envelope containing therein an insert which is smaller than the envelope to create a step in the envelope), tabbed and untabbed mail products, and mailpieces made from different substrates. Thus, the range of types and sizes of mailpieces which must be processed is extremely broad and often requires trade-offs to be made in the design of mixed mail feeding devices in order to permit effective and reliable processing of a wide variety of mixed mailpieces.

In known mixed mail handling machines which separate and transport individual pieces of mail away from a stack of mixed mail, the stack of "mixed mail" is first loaded onto some type of conveying system for subsequent sorting into individual pieces. The stack of mixed mail is moved as a stack by an external force to, for example, a shingling device. The shingling device applies a force to the lead mailpiece in the stack to initiate the separation of the lead mailpiece from the rest of the stack by shingling it slightly relative to the stack. The shingled mailpieces are then transported downstream to, for example, a separating device which completes the separation of the lead mailpiece from the stack so that individual pieces of mail are transported further downstream for subsequent processing. In the mailing machine described immediately above, the various forces acting on the mailpieces in moving the stack, shingling the mailpieces, separating the mailpieces and moving the individual mailpieces downstream often act in a counterproductive manner relative to each other. For example, inter-document stack forces exist between each of the mailpieces that are in contact with each other in the stack. The inter-document stack forces are created by the stack advance mechanism, the frictional forces between the documents, and potentially electrostatic forces that may exist between the documents. The inter-document forces tend to oppose the force required to shear the lead mailpiece from the stack. Additionally, the interaction of the force used to drive the shingled stack toward the separator and the separator forces can potentially cause a thin mailpiece to be damaged as it enters the separator. Furthermore, in a conventional separator, there are retard belts and feeder belts that are used to separate the mailpiece from the shingled stack. Both the forces applied by the retard belts and the feeder belts must be sufficient to overcome the inter-document forces previously discussed. However, the force of the retard belts cannot be greater than the force of the feeder belts or the mailpieces will not be effectively separated and fed downstream to another mail processing device. Moreover, if the feeding force being applied to the mailpieces for presenting them to the separator is too great, another potential problem which may occur is that a plurality of mailpieces will be forced through the separator without the successful separation of the mailpieces.

In view of the above, it is recognized that large forces are desirable to act on the mailpieces to accelerate and separate the mailpieces in a reliable and high throughput manner. However, these same high forces can damage the mailpieces being processed (i.e. buckled lightweight mailpieces). Conversely, if the forces used to accelerate and separate the mailpieces are too small, poor separation, a lower throughput, and stalling of the mailpieces being processed will result. Put in another way, thin mailpieces are weak and require low forces to prevent them from being damaged, while thick/heavy mail is strong and requires high forces for proper separation and feeding. Thus, the structure used to separate a stack of mixed mail must take into account the counterproductive nature of the forces acting on the mailpieces and be such that an effective force profile acts on the mailpieces throughout their processing cycle so that effective and reliable mailpiece separation and transport at very high processing speeds (such as four mailpieces per second) can be accomplished without physical damage occurring to the mailpieces. However, since the desired force profile acting on a particular mailpiece is dependent upon the size, thickness, configuration, weight, and substrate of the individual mailpiece being processed, the design of a mixed mail feeder which can efficiently and reliably process a wide range of different types of mixed mailpieces has been extremely difficult to achieve.

SUMMARY OF THE INVENTION

It is an object of the invention to provide a more effective singulating apparatus for use in a system which transports mixed sizes of articles.

The above objective is met by providing In an apparatus having a moving mechanism for moving articles of mixed sizes from a stack of articles of mixed sizes along a feed path, a singulator apparatus including a feed deck; forwardly driving structure, connected to the feed deck, for contacting the articles along a first surface thereof and for moving the articles in a first direction along the feed path and over the feed deck; a reverse driving mechanism, connected to the feed deck, for contacting the articles along a second surface thereof and for driving all but one of the articles in a second direction opposite to the first direction so that only one of the articles at a time is moved by the forwardly driving structure in the first direction along the feed path and over the feed deck, the forwardly driving structure and the reverse driving mechanism being connected to the feed deck relative to each other to define a nip therebetween; apparatus for sensing if at least one of the articles is present in the nip; a control, operatively connected to the sensing apparatus, for operating the moving means to move articles from the stack toward the nip at times when the sensing apparatus does not sense the presence of the at least one of the articles in the nip and for preventing the moving mechanism from moving articles from the stack toward the nip at times when the sensing apparatus senses the presence of the at least one of the articles in the nip.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENTS

Figure 1:
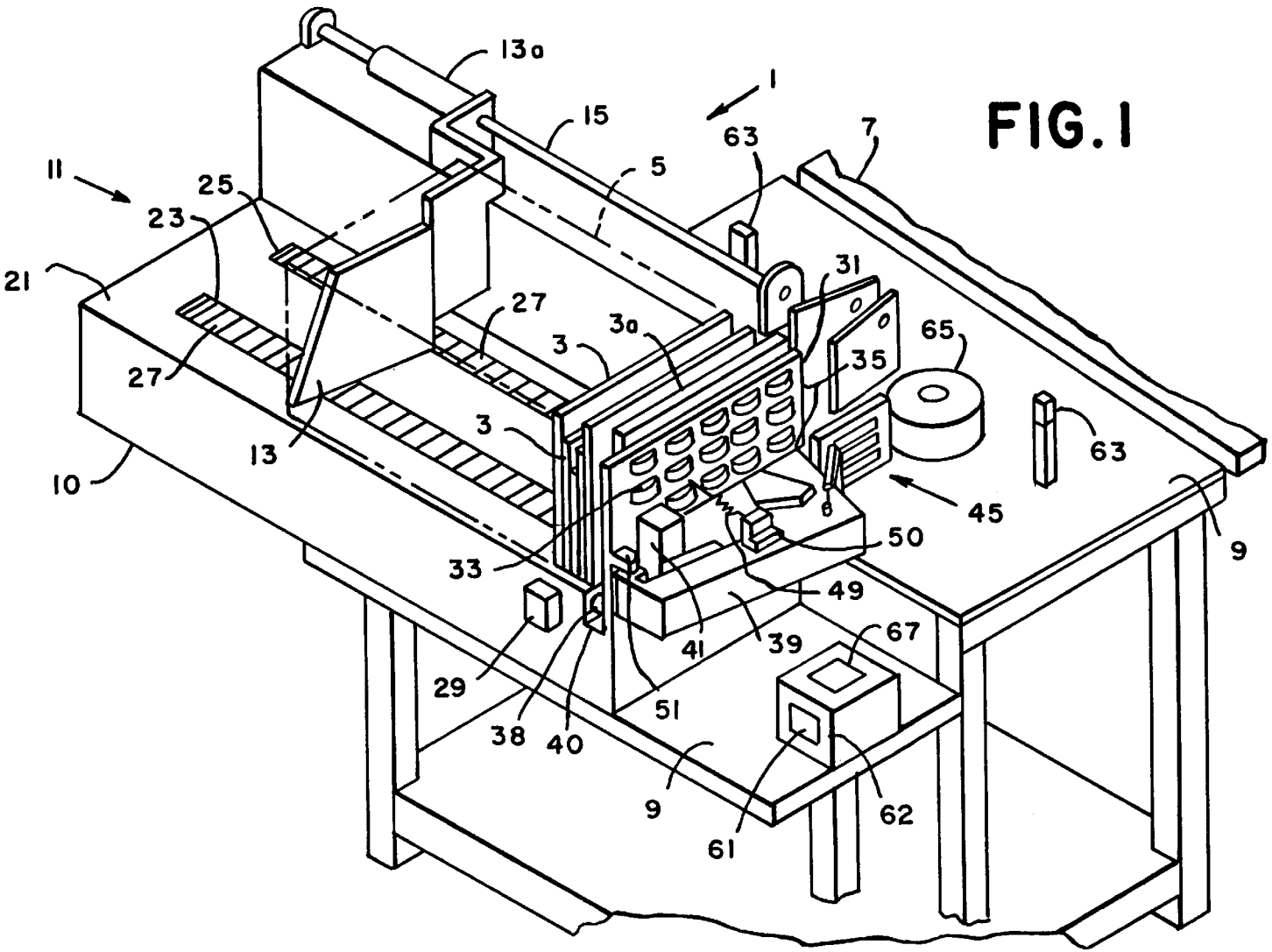
FIG. 1 is a perspective view of the inventive mail handling machine.
Figure 2:
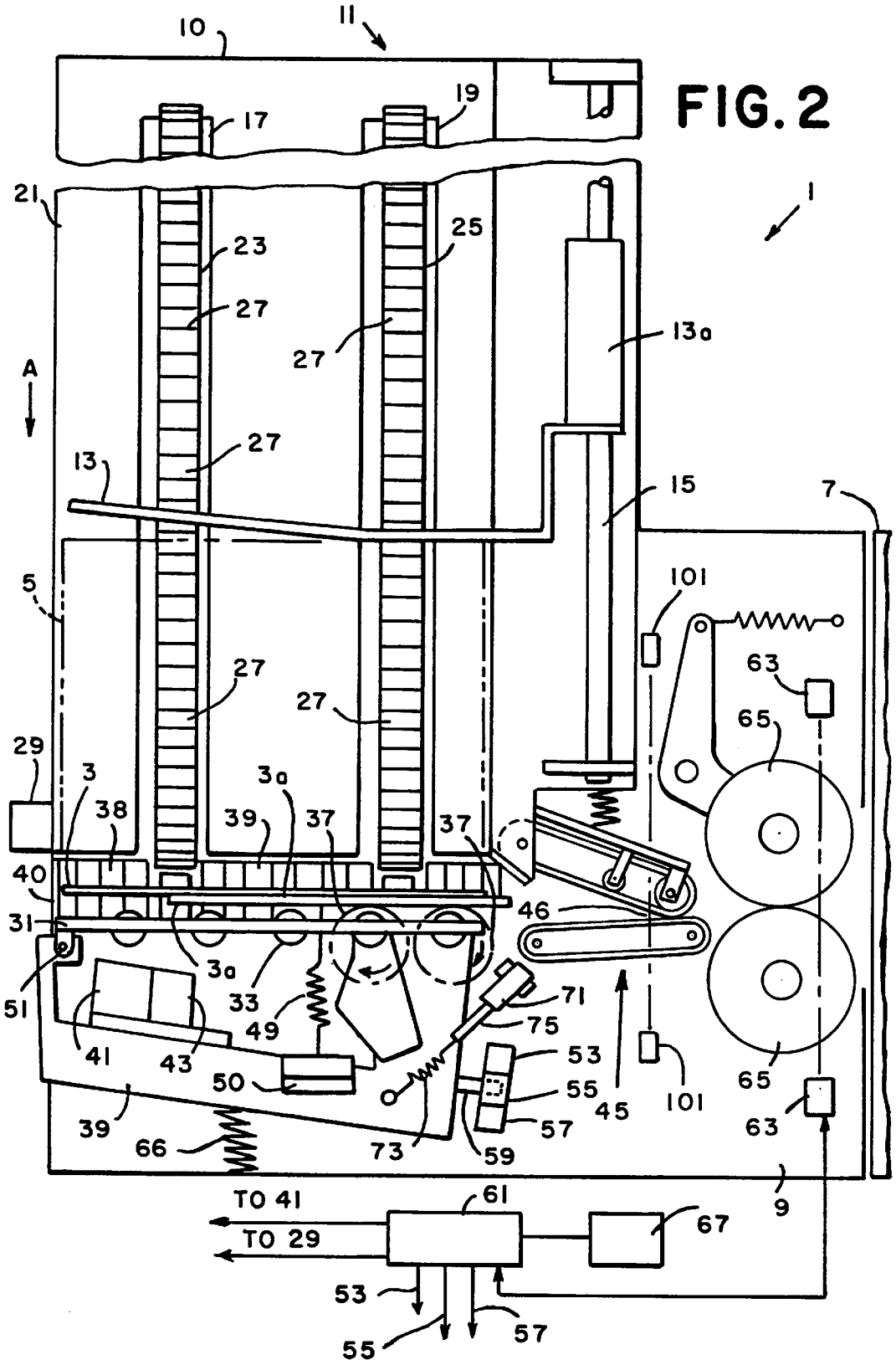
FIG. 2 is an enlarged to plan view of FIG. 1.

Referring to FIGS. 1 and 2, a mixed mail feeder 1 is shown. Mixed mail feeder 1, as will be discussed in more detail below, separates individual mailpieces 3 from a stack of mixed mail generally designated at 5 and transports the individual mailpieces 3 to a subsequent mail processing station 7. Mail processing station 7 can be any one of a plurality of devices such as a meter for printing postage on the mailpiece 3, an OCR reader for reading addresses off of the mailpiece 3, a sorting device for sorting the individual mailpieces 3 to designated bins or areas, or even a scale that weighs the mailpiece. The key point is that the mixed mail feeder 1 functions to separate individual mailpieces 3 from a stack of mixed mail 5 and deliver the individual mailpieces 3 sequentially to the mail processing station 7.

Mixed mail feeder 1 includes a table 9 upon which all of the components of the mixed mail feeder 1 are mounted. At an input end of the mixed mail feeder 1, generally designated by the arrow 11, the stack of mixed mail 5 is placed on edge by an operator in front of a guide wall 13. Guide wall 13 acts as a support against which the stack of mixed mail 5 rests. Moreover, guide wall 13 includes a cylindrical portion 13*a* which is mounted to slide on a guide rod 15 fixedly attached to platform 10 which is mounted to table 9.

Platform 10 has first and second slots 17,19, in a horizontal surface 21 thereof. The slots 17,19 each permit a top portion of a respective individual continuous belt 23, 25 to project therethrough. Belts 23, 25 each have a plurality of individual track portions 27 over the full extent of the belts 23, 25. The bottom of guide wall 13 removably fits in adjacent track portions 27 of each of belts 23 and 25 so that guide wall 13 moves with belts 23, 25 in the direction of arrow A. Moreover, as guide wall 13 moves in the direction of arrow A with the belts 23, 25, the cylindrical portion 13*a* slides along guide rod 15 to keep the standing orientation of guide wall 13 in the position shown in FIG. 1.

Continuous belts 23, 25 are mounted in a conventional manner around a pulley at each end (not shown). One pulley is an idler pulley while the other is driven by a motor 29. The motor 29 drives a common shaft (not shown) connected to the drive pulleys of each of the belts 23, 25 such that the belts 23, 25 will be driven at the same velocity to move around their respective idler and driven pulleys. Thus, as the belts 23, 25 move around the pulleys in the direction of arrow A, the guide wall 13 moves therewith so that the entire stack of mixed mail 5 is moved toward a nudger wall 31. As will be discussed in more detail below, the stack of mixed mail 5 will have individual mailpieces 3 moved from the stack downstream so that the stack of mixed mailpieces is continuously reduced in size. When the guide wall 13 has been moved to a point where it is desirable to add additional pieces of mixed mail to the stack, the guide wall 13 can be lifted out of the individual tracks 27 of the belts 23, 25 by pulling the guide wall 13 up to rotate, via the cylindrical portion 13*a,* about the guide rod 15. Once the bottom of the guide wall 13 is clear of the individual tracks 27 of the belts 23, 25, it can be slid backward in the opposite direction from that of arrow A and placed in a desired position to receive additional mixed mail.

Figure 3:
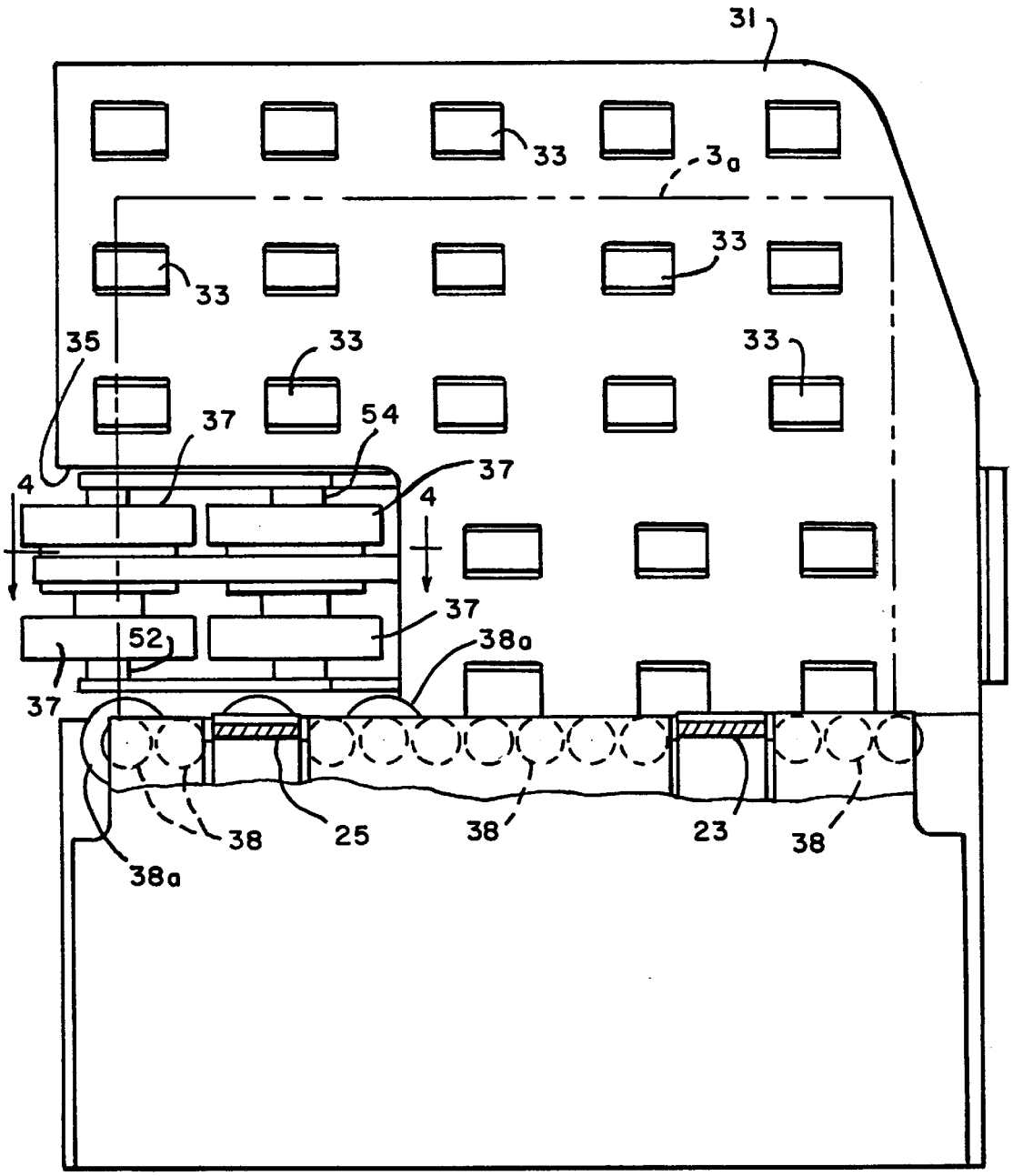
FIG. 3 is an enlarged detailed view of the nudger wall of FIG. 1.

Referring to FIG. 1, 2, and 3, nudger wall 31 includes a plurality of rollers 33 mounted therein in a conventional manner to be freely rotatable. Furthermore, nudger wall 31 has a cutout 35 in a lower corner thereof through which driven nudger rollers 37 project. Moreover, a plurality of roller bars 38 are rotatably mounted in a conventional manner in a slot 40 of platform 10. Thus, as guide wall 13 pushes the stack of mixed mail 5 toward nudger wall 31, individual pieces of mail 3 fall off the end of belts 23, 25 on top of the rollers 38 and into contact with the nudger rollers 37. While in the preferred embodiment the roller bars 38 are not driven, they could be driven to provide additional forward feed force to the mailpiece 3. In one embodiment, a continuous belt (not shown) is driven around the roller bars 38. The use of the continuous belt provides a greater coefficient of friction as compared to the roller bars and thus improves the feed force and provides for a simple drive structure.

Figure 4:
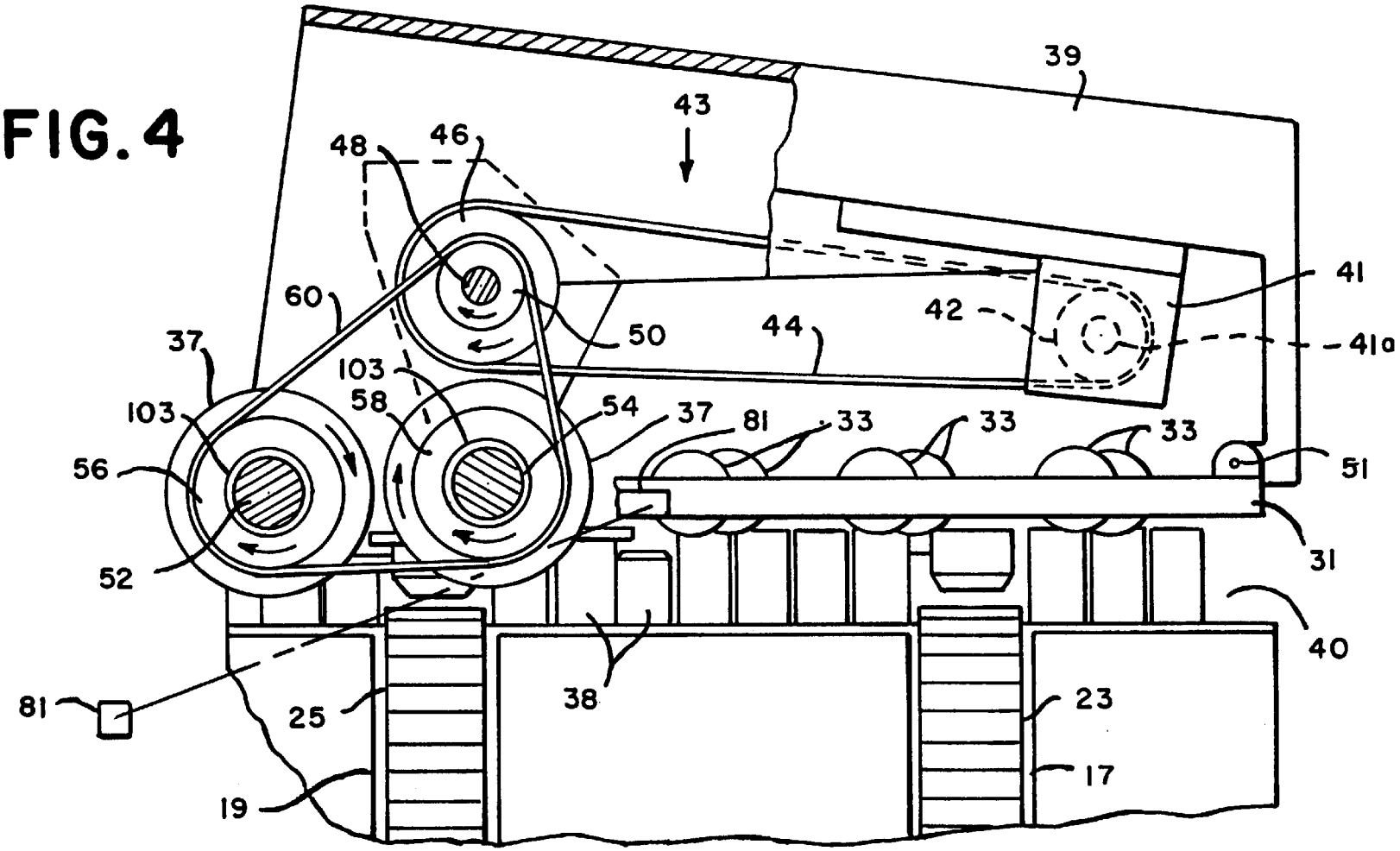
FIG. 4 is an enlarged top plan view partially in section along line IV—IV of FIG. 3 showing details of the nudger roller drive system.

The nudger rollers 37 are mounted to be driven into rotation within a nudger arm 39. The four nudger rollers 37 are driven together by a motor 41, mounted on nudger arm 39, via a drive train 43 as shown schematically in FIG. 2 and in detail in FIG. 4. As shown in FIGS. 2 and 4, all of the nudger rollers 37 are driven into rotation in a clockwise direction. Accordingly, as the stack of mixed mail 5 is moved toward nudger wall 31, the lead mailpiece 3*a* is forced into contact with the nudger rollers 37. The force of the driven nudger rollers 37 acts against the lead mailpiece 3*a* to move the mailpiece 3*a* in the direction of a separator device 45, thereby shingling the lead mailpiece 3*a* from the stack of mixed mail 5 as shown in FIGS. 1 and 2. The shingled stack is then transported to the nip 46 of separator 45 which separates the lead mailpiece 3*a* from the shingled stack and delivers it to take-away rollers 65 which transport the individual lead mailpiece 3*a* further downstream to mail processing station 7.

Referring to FIGS. 3 and 4, the details of the drive system 43 are shown. Motor 41 has a shaft 41a connected to a pulley 42. A continuous belt 44 is disposed around pulley 42 and a second pulley 46. Pulley 46 is fixedly mounted to a rotatable shaft 48 mounted in nudger arm 39. Also, fixedly mounted to shaft 48 is a third pulley 50. Additional shafts 52, 54 are also rotatably mounted in nudger arm 39 and respectively have fourth and fifth pulleys 56, 58 fixedly mounted thereto. Nudger rollers 37 are mounted on a corresponding one of shafts 52, 54. Accordingly, as motor 41 rotates pulley 42 in the clockwise direction of FIG. 4, pulley 46 and hub 48 are drive in the clockwise direction as well. Since a continuous belt 60 passes around pulleys 48, 56, and 58, shafts 52, 54 are forced to rotate in the clockwise direction causing a corresponding rotational movement in all of nudger rollers 37.

In order for the nudger rollers 37 to effectively feed the stack of mixed mail into the separator 45, accurate control of the normal force applied to the stack of mixed mail 5 by the interaction of the guide wall 13 and the nudger rollers 37 needs to be achieved. The normal force is created by a spring 49 that is fixedly mounted at one end to the nudger wall 31 and at its other end to a mounting platform 50 of nudger arm 39. The nudger arm 39 is pivotally mounted about a conventional pivot structure 51 so that the spring 49 biases the nudger rollers 37 through the cutout 35 and into contact with the lead mailpiece 3*a*. Thus, as the guide wall 13 is advanced in the direction of the nudger wall 31, the nudger arm 39 is forced to rotate in the clockwise direction of FIG. 2 around pivot structure 51 in opposition to the biasing force of the spring 49. As the spring 49 is extended due to the rotation of nudger arm 39 about the pivot structure 51, the force exerted by the spring 49 is continually increased.

As discussed above, it is desirable to regulate the amount of normal force being exerted by the spring 49, via the nudger rollers 37, on the stack of mixed mailpieces 5 to ensure that only the minimal amount of normal force required to permit the nudger rollers 37 to move each of the mixed mailpieces 3 toward the separator 45 is applied. That is, it is not desirable to continuously run motor 29 to constantly advance the guide wall 13 toward the nudger wall 31. If this occurs, spring 49 will be extended to a length that applies too great a normal force on the lead mailpiece 3*a*. While this greater normal force may be acceptable for feeding heavier mailpieces 3 toward the separator 45, it can create a significant problem for very thin mailpieces and untabbed mailpieces. That is, as the thin and untabbed mailpieces are fed by the nudger rollers 37 into the separator 45, they can easily be buckled and damaged due to the feeding force of the nudger rollers 37 and the forces exerted by separator 45. Additionally, if the guide wall 13 is advanced too far toward the nudger wall 31 the stack of mixed mail 5 will be clamped in place preventing the feeding of individual mailpieces from stack 5. To prevent this from happening, the contact point of the nudger rollers 37 against the lead mailpiece 3*a* is always maintained closer to the stack 5 than the facing surface of the nudger wall 31 is to the stack 5. This is accomplished by ensuring that the rotation of arm 39 is controlled (as discussed in more detail below) so that the contact point of the nudger rollers 37 against the mailpieces occurs between 7 to 16 millimeters away from guide wall 31 (contact point of rollers 37 extends beyond wall 31 in this range). This configuration permits the guide wall 31 to provide support to large mailpieces while at the same time it does not provide a surface at which the mailpieces can be clamped in place. Correspondingly, if the guide wall 13 is not advanced sufficiently enough toward nudger wall 31, the spring 49 will only be extended to provide a very small normal stack force. If this force is too small, the action of the driven rotating nudger rollers 37 on the lead mailpiece 3*a* will be insufficient to overcome the inter-document forces existing between individual pieces of the stack of mixed mail 5 such that the shingling of the mailpieces 3 and the advancement of the shingled stack toward separator 45 will not occur and a stalled condition at nudger wall 31 occurs. Thus, as described above, the normal force which is created by the positioning of the mailpiece stack 5 against the nudger rollers 37 and the corresponding force created by the extension of spring 49 needs to be maintained in an approximate range of 1–2 newtons in order to ensure that the various types of mixed mailpieces 3 which may be processed are properly shingled and fed vertically into the throat of separator 45 without being damaged or stalled at nudger wall 31.

Since the normal force is provided by the extension of spring 49, it can be controlled by accurately regulating the position of nudger arm 39 which correspondingly regulates the extension of spring 49. That is, since the normal force applied by spring 49 is directly proportional to its extension, the normal force that it applies to the stack of mixed mail 5 is controlled by regulating the extension of spring 49.

The aforementioned control of the extension of spring 49 and rotation of nudger arm 39 is accomplished via the utilization of conventional through-beam sensors 53, 55, and 57 and a finger 59 which projects from nudger arm 39. As nudger arm 39 rotates about pivot structure 51, the finger 59 will move between the three sensors 53, 55 and 57. When finger 59 blocks an individual one of the through-beam sensors 53, 55, and 57, a signal is sent by the respective blocked through-beam sensor to a mixed mail feeder microprocessor 61 indicating the position of the finger 59 at the blocked sensor. The known position of the finger 59 corresponds to a known position of the nudger arm 39 and a known amount of extension of the spring 49. Thus, at any of the positions where the finger 59 blocks one of the sensors 53, 55, and 57, the exact normal force being applied by spring 49 through the nudger rollers 37 on the stack of mail 5 is known.

If the finger 59 is blocking the beam of the first sensor 53, the microprocessor 61 knows that the nudger rollers 37 are at their innermost position relative to the stack of mixed mail 5. At this position, the normal force exerted by spring 49 is below the desired minimum value of 1 newton and must be increased. The increase in normal force is created when the microprocessor 61, in response to a signal from sensor 53, energizes the motor 29 to move the belts 23 and 25 such that the guide wall 13 advances the mixed mail stack 5 into the nudger rollers 37. The motor 29 will advance the stack of mixed mail 5 until the nudger arm 39 pivots about pivot structure 51 to the position where finger 59 blocks the through-beam sensor 55. When this occurs, the sensor 55 sends a signal to microprocessor 61 which in turn deenergizes motor 29 stopping the advance of the stack of mixed mail 5 toward the nudger rollers 37. In this position, the nudger rollers 37 are considered to be in the "out" position where the maximum desired normal force is being exerted on the lead mailpiece 3*a* due to the extension of the spring 49. Subsequently, as mail is fed from the stack of mixed mail 5 toward the separator 45 due to the action of the rotating nudger rollers 37, the nudger rollers 37 gradually move toward the innermost normal force position. When the nudger arm 39 has rotated inwardly such that the nudger rollers 37 are in the innermost normal force position, microprocessor 61 receives a signal from sensor 53 and energizes motor 29 to advance the stack of mail 5 until the second sensor 55 is blocked by the finger 59. In this manner, constant regulation of the normal force in the predetermined range is maintained.

In a first preferred embodiment, the automatic control of the normal force, as described above, would only use the sensors 53 and 55 to ensure that the normal force generated by the nudger rollers 37 stays within the predetermined desired normal force range. However, in a second preferred embodiment, a second tier of additional stack force can be applied if it is determined that a mailpiece 3 has stalled at the nudger rollers 37 or at the separator 45. That is, it is possible, since the mixed mail feeder 1 is designed to handle many different types of mixed mail, that a very heavy piece of mail may have stalled (become stuck) at the nudger rollers 37 or separator 45. This situation would occur when the normal force applied by the nudger rollers 37 is insufficient to shingle the heavier mailpieces from the stack of mixed mail 5 and move the shingled stack downstream into the nip of the separator 45. If stalling occurs, the mixed mail feeder 1 is essentially in a jammed or inoperative position. The way in which the mixed mail feeder 1 determines that a stall has occurred is by the use of a through-beam sensor 63, which is positioned proximate to the nip of takeaway rollers 65. Takeaway rollers 65, in a conventional manner, receive individual mailpieces from separator 45 and move the individual mailpieces 3 downstream. Thus, if the takeaway rollers 65 feed a first mailpiece and do not process a second mailpiece 3 downstream in a predetermined period of time of, for example, 1,000 msec, the through-beam of sensor 63 does not detect the lead edge of the second mailpiece during that same predetermined time period. If the microprocessor 61 does not receive an indication from the sensor 63 that a leading edge of the second mailpiece has passed thereby within the predetermine period of time, microprocessor 61 is programmed to assume that a stall has occurred somewhere upstream. Microprocessor 61 then energizes motor 29 to cause the stack of mixed mail 5 to be moved toward the nudger wall 31. The nudger arm 39 is forced rotate about the pivot point 51 and the spring 49 is further extended. Motor 29 is driven until nudger arm 39 is advanced to block the third sensor 57. In this position, a stalled normal force, which is larger than the maximum normal force applied under normal operating conditions, is being exerted on the lead mailpiece 3*a* by the nudger rollers 37 and the motor 29 is rendered inoperative by microprocessor 61. The increased normal force can simply be due to the further extension of the spring 49 as the nudger arm 39 is rotated from its position blocking sensor 55 to its position blocking sensor 57, or can be further increased by the force of an additional compression spring 66 which only contacts the nudger arm 39 to provide an additional spring force thereto when the nudger arm 39 moves beyond the position from the blocking of sensor 55 toward the blocking of sensor 57. Assuming that the additional normal force applied is sufficient to move the stalled mailpiece 3, the takeaway sensor 63 will provide an input to the microprocessor 61 identifying that the lead edge of the stalled mailpiece has passed thereby and the processing of individual mailpieces 3 will continue by driving the nudger rollers 37 until the nudger arm 39 moves to a position where the first sensor 53 is blocked by finger 59. At this position, the system will operate as discussed above, regulating a force profile by maintaining the position of nudger arm 39 between the sensors 53 and 55. In the event however, that even the additional normal force provided by the movement of the nudger arm 39 to block the sensor 57 does not correct the stalled problem, the microprocessor 61, after a predetermined period of time, will provide an input to the user via a display 67 identifying the stalled condition and advising that operator intervention is required to correct the problem. As is readily apparent to one skilled in the art, the microprocessor 61 controls all of the motors typically associated with the stack advance, shingling device, separator, and take away rollers and includes known clock structure for determining the predetermined time periods discussed above. Empirical testing has shown that for the anticipated mixed mailpiece profile the additional normal force applied during movement of finger 59 from sensor 55 to sensor 57 goes from 2 to 5 newtons.

In yet another embodiment of the invention, a different mechanism is used to provide additional force in the situation where stalled mail is detected. That is, once the microprocessor 61 determines that a stall has occurred, utilization of a solenoid 71 and another spring 73 provides additional normal force in an attempt to overcome the stalled situation. The solenoid 71 is fixedly mounted to the platform 9 and the spring 73 has one end fixedly mounted to the nudger arm 39 and a second end fixedly mounted to a moveable plunger 75 of solenoid 71. When the nudger arm 39 is positioned in the normal force operating range, the spring 73 is slack, thereby providing no additional normal spring force. However, when stalled mail is detected, the microprocessor 61 energizes the solenoid 71 to withdraw the plunger 75 such that the spring 73 is extended to provide an additional normal force to the mixed mail stack 5 via the nudger rollers 37. The force applied by the solenoid/spring combination 71/73 can be consistently applied for a predetermined period of time or can be pulsed to help the stalled mail break away. Moreover, in a more complex arrangement, different levels of force can be applied by the spring 73 and solenoid 71 combination over a predetermined time period in an attempt to break the stalled mailpiece away. The gradual application of increased forces has the benefit of not immediately providing too great a force to the stalled mailpiece, which force could potentially damage the piece of mail if it is too great. The advantages of using the solenoid/spring 71/73 combination is that, unlike the previously described embodiments, the application of the additional force does not depend on the stack advance response time such that the stalled mail situation is corrected faster thereby improving the overall throughput of the mixed mail feeder. Additionally, the use of the solenoid/spring 71/73 combination reduces the range of nudger roller 37 motion, thereby "aiming" the mail at the feeder closer to the optimum area. Finally, while FIG. 2 shows each of the springs 49, 66 and 73, each of these springs either alone or in combination can be used to provide the desired normal force.

Figure 5:
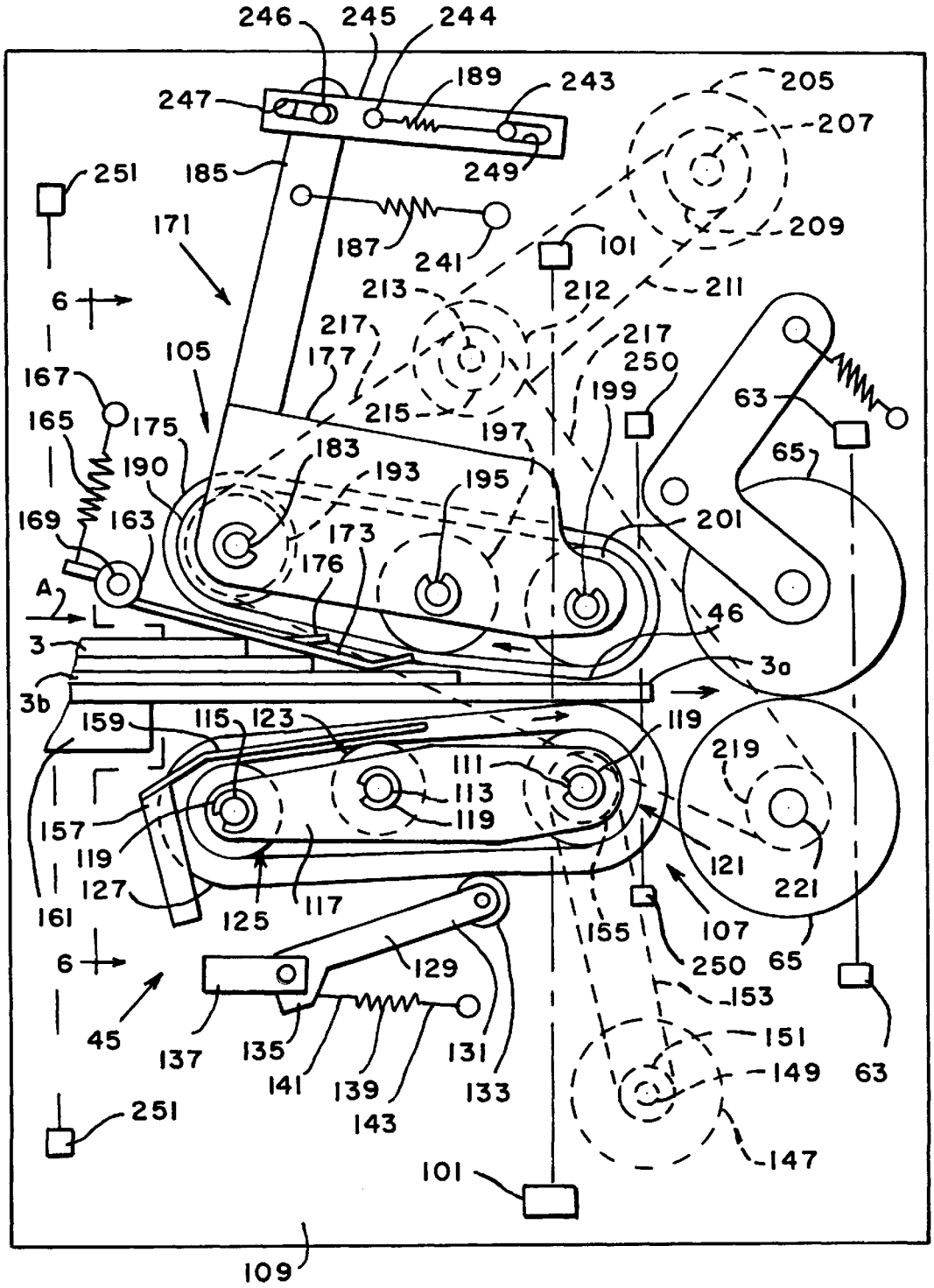
FIG. 5 is an enlarged detailed top plan view of the separator of FIG. 1.
Figure 6:
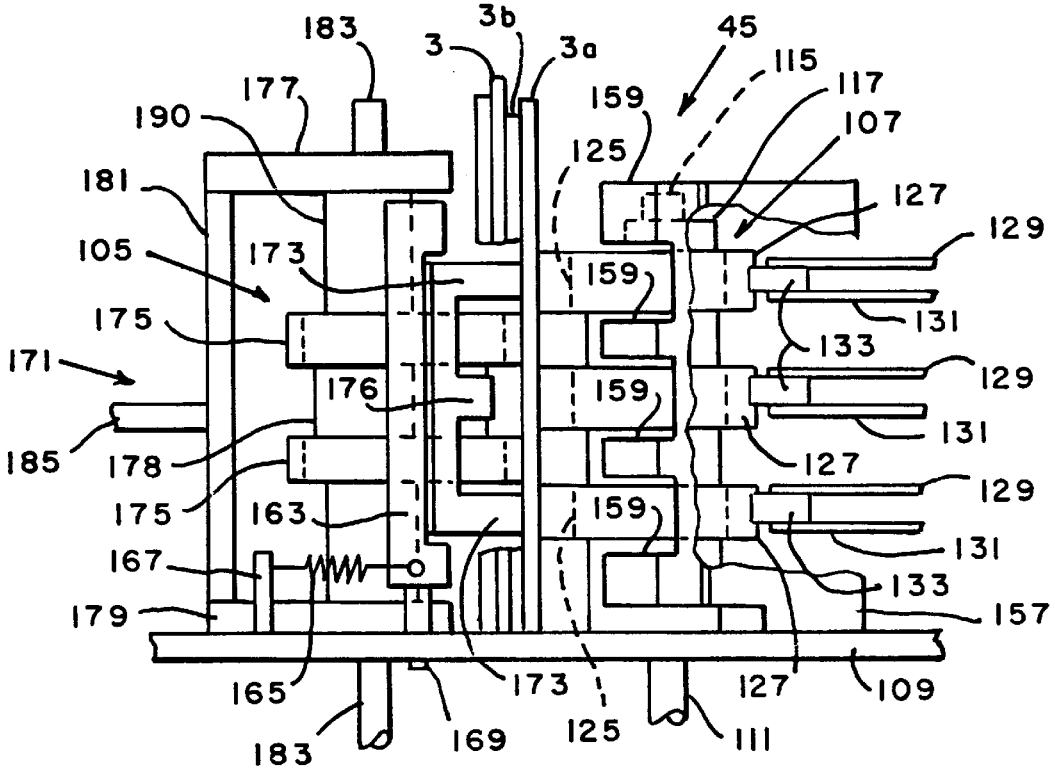
FIG. 6 is an end view taken along line VI—VI of FIG. 5.
Figure 7:
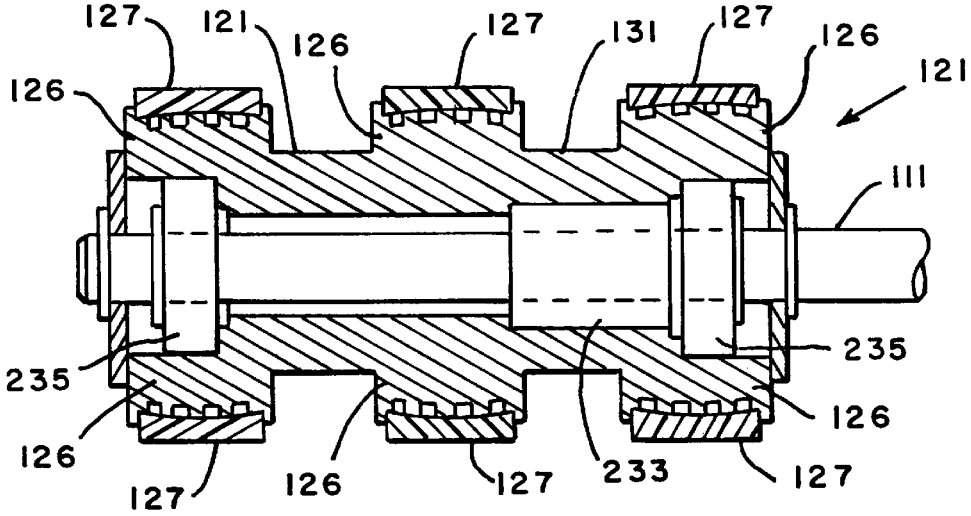
FIG. 7 is a cross-section of the driven pulley of the feed assembly.
Figure 8:
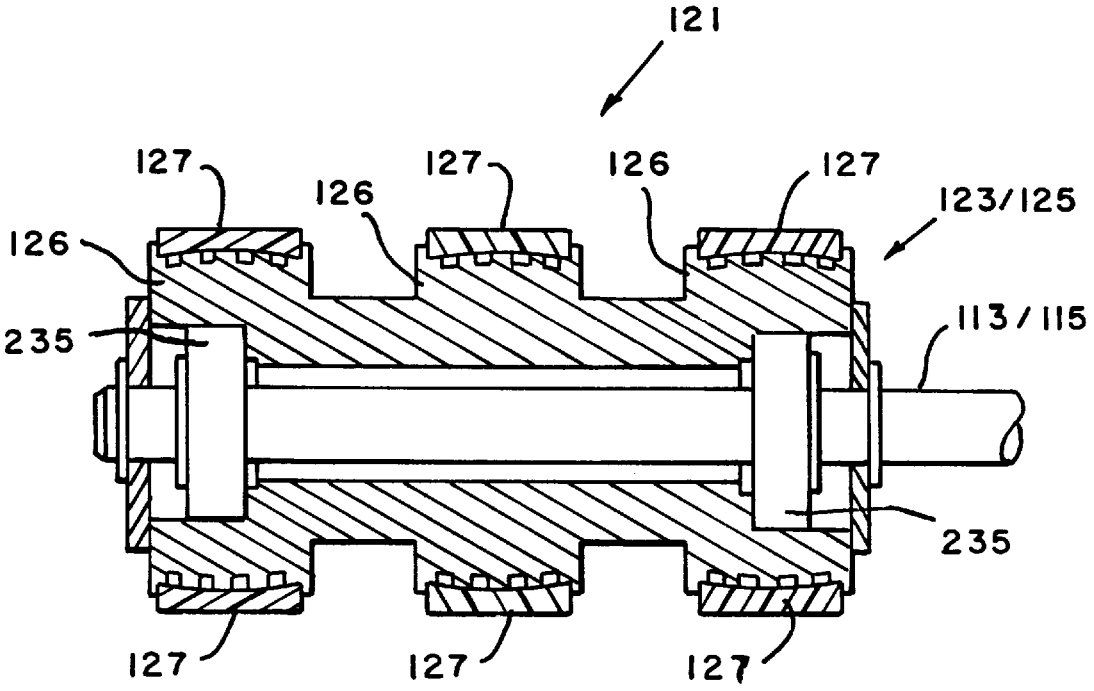
FIG. 8 is a cross-section of the idler pulley of the feed assembly.

Referring to FIGS. 5 and 6, separator 45 includes a reverse belt assembly 105 and a feed belt assembly 107. Feed belt assembly 107 is fixedly mounted to a feed deck 109. Shafts 111, 113, and 115 are fixedly mounted in feed deck 109 and end plate 117. Clips 119 retain shafts 111, 113 and 115 in end plate 117 while shaft 111 is mounted for rotation therein. Pulley assemblies 121, 123, and 125 are respectively mounted on shafts 111, 113, and 115 to be rotatable thereabout. FIGS. 7 and 8 respectively show the mounting structure of the driven pulley 121 and the idler pulleys 123/125. As shown, each of the idler pulley assemblies 123/125 is mounted on ball bearings 235 about their respective shafts 113/115. Driven pulley assembly 121 is also mounted on ball bearings 235 but is also mounted on an overrunning clutch 233 for purposes to be discussed later. Each pulley assembly 121/123/125 has three serrated, crowned hub portions 126 around which a respective one of each of three continuous belts 127 is disposed. Moreover, a bracket 129 has a free end 131 at which a roller 133 is mounted for rotation and a second end 135 which is pivotably mounted to a bracket 137 which itself is fixedly mounted to feed deck 109. A spring 139 has a first end 141 connected to the second end 135 of bracket 129 and a second end 143 fixedly mounted within the mail handling machine. Spring 139 biases roller 133 into belt 127 to maintain a proper belt tension. As shown in FIG. 6, there is a tension roller 133 for each belt 127.

The feed belt assembly 107 is driven by a motor 147 which is controlled by microprocessor 61. A shaft 149 is driven by motor 147 and in turn drives a pulley 151 which is fixedly mounted to shaft 149. A continuous belt 153 is disposed around pulley 151 and also around a pulley 155 fixedly mounted to a lower portion of shaft 111 which extends below deck 109. Thus, as motor 147 rotates shaft 149 in the clockwise direction of FIG. 5, pulley 151, pulley 155, shaft 111, and pulley assembly 121 also rotate in the clockwise direction. The clockwise rotation of pulley assembly 121 causes belts 127 to move in the clockwise direction with idler pulley assemblies 123/125, thereby feeding the lead mailpiece 3*a* toward the take away rollers 65.

Feed belt assembly 107 also includes a guide 157 fixedly attached to feed deck 109. Guide 157 includes 4 fingers 159 which extend on either side of the three feed belts 127. As the mailpieces 3 are moved in the direction of arrow "A" by the nudger system (represented schematically as 161 in FIG. 5) the guide 157 prevents the mailpieces from hitting and getting caught on the three belts 127 and guides the mailpieces 3 toward separator nip 46. This prevents the mailpieces 3 from being routed behind feed belt apparatus 107.

Reverse belt assembly 105 includes a mailpiece ingestion guide plate 163 that is pivotably mounted to feed deck 109 and biased toward mailpieces 3 by spring 165. Spring 165 is connected to a post 167 fixed to base 109. Ingestion guide 163 is mounted on and pivots about a shaft 169 which itself is fixedly mounted at one end in feed deck 109. Thus, as mailpieces 3 enter nip 46, the ingestion guide 163 via its outboard fingers 173 contacts and applies a normal force to the lead mailpiece 3*a*. Middle finger 176 prevents mail from curling up between the reverse belt assembly retard belts 175. It is important to note that the positioning of the biased ingestion guide 163 within nip 46 helps to solve two fundamental problems associated with the separation and feeding of mixed mail. Firstly, if some of the mailpieces 3 are a very thin material it is possible that when the separator 45 acts to separator the lead mailpiece 3*a* from the shingled stack of mailpieces 3, the thin mailpieces 3 buckle in nip 46 instead of being separated and fed toward the take away rollers 65. The presence of the biased ingestion guide 163 helps to stabilize thin mailpieces thereby reducing significantly the buckling problem discussed above and preventing damage to thin mailpieces. Secondly, in order to further prevent the curl up situation from occurring a through-beam sensor 101 is located just upstream from nip 46. The sensor provides an indication to microprocessor 61 as to whether a mailpiece 3 is present. If no mailpiece is sensed as being present microprocessor 61 operates the nudger rollers 37 to continue feeding mailpieces 3 toward the nip 46. However, if sensor 101 senses the presence of a mailpiece 3, microprocessor 61 stops the feeding of mailpieces by nudger rollers 37. Since the mailpieces are only being acted upon by the separator 45 and not the nudger rollers 37, it is less likely that thin mailpieces will curl up in the nip. However when the nudger rollers 37 are stopped, the sensed mailpiece has not been fully ingested in nip 46 and it is possible that in some instances the feed belts 127 will not be able to move the lead mailpiece 3*a* into nip 46 such that a stall occurs. This situation might occur when a glossy piece of mail with a low coefficient of friction is present or even when a thicker mailpiece is present. The biased ingestion guide 163 provides a normal force against the mailpiece 3*a* which increases the feed force of the feed belts 127 to help prevent the stalled mail situation. Thirdly, the ingestion guide 163 assists in the feeding of short mailpieces which leave the nudger rollers 37 before being fully ingested in to nip 46. Furthermore, it is to be noted that initially the Applicants used fingers 173, 176 that were covered with urethane. However, this lead to an unacceptable number of stalls. Accordingly, the fingers 173,176 were either covered with aluminum tape or made from aluminum or stainless steel which significantly reduced the number of stalls observed. However, other materials and ingestion angles by be utilized to help separate the mailpieces Finally, if the sensor 101 does not detect the presence of a mailpiece 3 within a predetermined to me period of, for example, 1,000 msec, the microprocessor assumes a stall has occurred upstream and causes the nudger rollers 37 to feed mailpieces toward nip 46 while concurrently increasing the normal stack force as described above in connection with take away sensor 63.

Main bracket assembly 171 includes a top bracket portion 177 and a bottom bracket portion 179 which are interconnected via an intermediate bracket portion 181. Main bracket assembly 171 is mounted to be freely rotatably around a drive shaft 183. Furthermore, extending from intermediate bracket portion 181 is a lever arm 185. Lever arm 185 is connected to a first spring 187 and a second spring 189. Each of springs 187 and 189 are mounted to bias the main bracket assembly 171 toward the mailpieces 3 as will be discussed in more detail below.

Fixedly mounted on shaft 183 is a pulley assembly 190 having two crowned hub portions (not shown but similar to the pulley/hub configuration of FIG. 7) around which belts 175 are disposed. Also fixedly mounted on shaft 183 is a second pulley 193. Additionally, a second shaft 195 is fixedly mounted at each end in brackets 177 and 179 and has a pulley assembly (with two hub portions not shown) 197 mounted for rotation thereabout in the same manner as shown in FIG. 8. Likewise, a third shaft 199 is also fixedly mounted between end brackets 177 and 179 and has a pulley assembly (with two hub portions not shown) 201 mounted for rotation thereabout in the same manner as shown in FIG. 8. Thus, the two belts 175 are each disposed around a respective hub of each of the pulley assemblies 190,197,201. Additionally, a roller 178 is mounted for rotation on pulley 190. Roller 178 rides on the middle feed belt 127 when no mail is present.

In operation, shaft 183 is driven into rotation in the clockwise direction of FIG. 5 causing the pulley assembly 190 to rotate therewith which in turn causes the belts 175 to move around the idler pulley assemblies 197 and 201. Thus, as a lead mailpiece 3*a* and the next mailpiece 3b enter the nip 46, feed belts 127 drive the lead mailpiece 3*a* toward the take away rollers 65 while the opposite rotation of the reverse belt assembly belts 175 separate the second mailpiece 3b from the lead mailpiece 3*a* so that only a single mailpiece 3*a* is removed by the take away rollers 65 and processed further downstream. That is, the feeding force of the feed belts 127 is greater than the reverse drive force of the reverse belts 175 which is greater than the interdocument forces. Thus, the force of the feed belts 127 and the reverse belts 175 overcome the interdocument forces to shear the mailpieces away from each other.

Drive shaft 183 is driven into rotation as follows. A motor 205 is fixedly mounted below feed deck 109. Motor 205 drives a shaft 207 into clockwise rotation which causes a pulley 209 attached to the shaft 207 to rotate in that same direction. A continuous belt 211 is disposed around pulley 209 and another pulley 212. Pulley 212 is fixedly connected to a shaft 213 upon which another pulley 215 is fixedly connected. Thus, as the shaft 207 is forced to rotate, all of the pulleys, 209 212, and 215 are forced to rotate in the clockwise direction. A second continuous belt 217 is disposed around pulley 215, pulley 193 and a pulley 219 associated with take away rollers 65. Thus, the motor 205 which is controlled by microprocessor 61 not only drives the shaft 183 in the clockwise direction but at the same time the shaft 221 around which the take away roller pulley 219 is mounted is driven in the clockwise direction. Thus, a single motor 205 drives the retard assembly belts 175 to separate the mailpieces as well as the take away rollers 65 for accelerating and feeding the lead mailpiece 3*a* downstream. However, as previously discussed, the feed assembly belts 127 are driven by a separate motor 147.

The reason for driving the feed belt assembly 107 with a different motor than both the reverse belt assembly 105 and the take away rollers 65 is to prevent a problem which can occur in known singulating apparatus where the take away rollers, the reverse belt assembly, and the feed belt assembly are all driven by a single motor. That is, in the situation where a single motor is used the entire singulating assembly may fail to separate the second mailpiece 3b from the lead the mailpiece 3*a* such that two mailpieces in overlapping relationship to each other (known as a "double") are passed out of the singulator assembly and fed into the take away rollers 65. In this situation it is often the case that the take away rollers may continue to feed the double mailpiece structure. Since the purpose of the singulating apparatus is to ensure that only individual pieces of mail are processed downstream, this is an undesirable situation. By utilizing two separate motors the possibility of a double feed is greatly reduced. That is, in the inventive apparatus when the lead edge of the lead mailpiece 3*a* is detected by the sensor 63, the microprocessor 61 will stop the motor 147 from driving the feed belt assembly belts 127. Thus, even if a double feed is present it will not continue to be driven by the feed belts 127 toward the take away rollers 65. Rather, the take away roller 65 will pull the lead mailpiece 3*a* while the belts 175 of the reverse belt assembly 105 are still driven to separate the second mailpiece 3*b* away from the lead mailpiece 3*a*. Thus, the capability of the singulating apparatus to ensure that doubles are not feed to the take away roller 65 is effectively enhanced. Moreover, when the sensor 63 detects the trail edge of the lead mailpiece 3*a,* the feed roller belts 127 are once again driven to separate the next mailpiece (in this case 3*b*) from the shingled stack of mail. Additionally, to improve the ingestion of thick mailpieces, it is highly desirable to use rollers of approximately four inches in diameter.

The above described control of the feed belt assembly 107, reverse belt assembly 105, and take away rollers 65 is highly desirable to improve the separation function of the singulating apparatus. However, it should be noted that the lead mailpiece 3*a,* when being pulled out of the nip 46 by the take away rollers 65 will have a drag force exerted on its trailing end portion because of the friction force of the feed belt assembly belts 127. This drag force reduces the efficiency at which the take away rollers 65 can accelerate the lead mailpiece away from the feed belts 127 and possibly could cause damage, such as a tear, to occur to the mailpiece. In order to reduce this drag force to permit the lead mailpiece 3*a* to be pulled away effectively without being damaged, the driven pulley assembly 121 is mounted as shown in FIG. 7. FIG. 7 shows that pulley assembly 121 is mounted on drive shaft 111 via a needle bearing clutch 233. Moreover, the pulley assembly 121 is also mounted on ball bearings 235. In operation, when the shaft 111 is driven in the clockwise direction of FIG. 5 the needle bearing clutch 233 engages the pulley assembly 121 and drives it into rotation therewith causing the feed belts 127 to move in a corresponding manner. However, when the shaft 111 is not being driven by motor 147 and the take away rollers 65 pull the lead mailpiece 3*a* away from the feed belts 127, the nature of the needle bearing clutch allows the pulley assembly 121 to spin freely about the ball bearings 235. This reduces the drag created on the tail end of the lead mailpiece 3*a* thereby effectively permitting the take away rollers to remove the lead mailpiece 3*a* without any damage thereto. Additionally, clutch 233 minimizes sliding contact between the feed belts 127 and the mailpieces thereby reducing wear on the feed belts 127.

Figure 9:
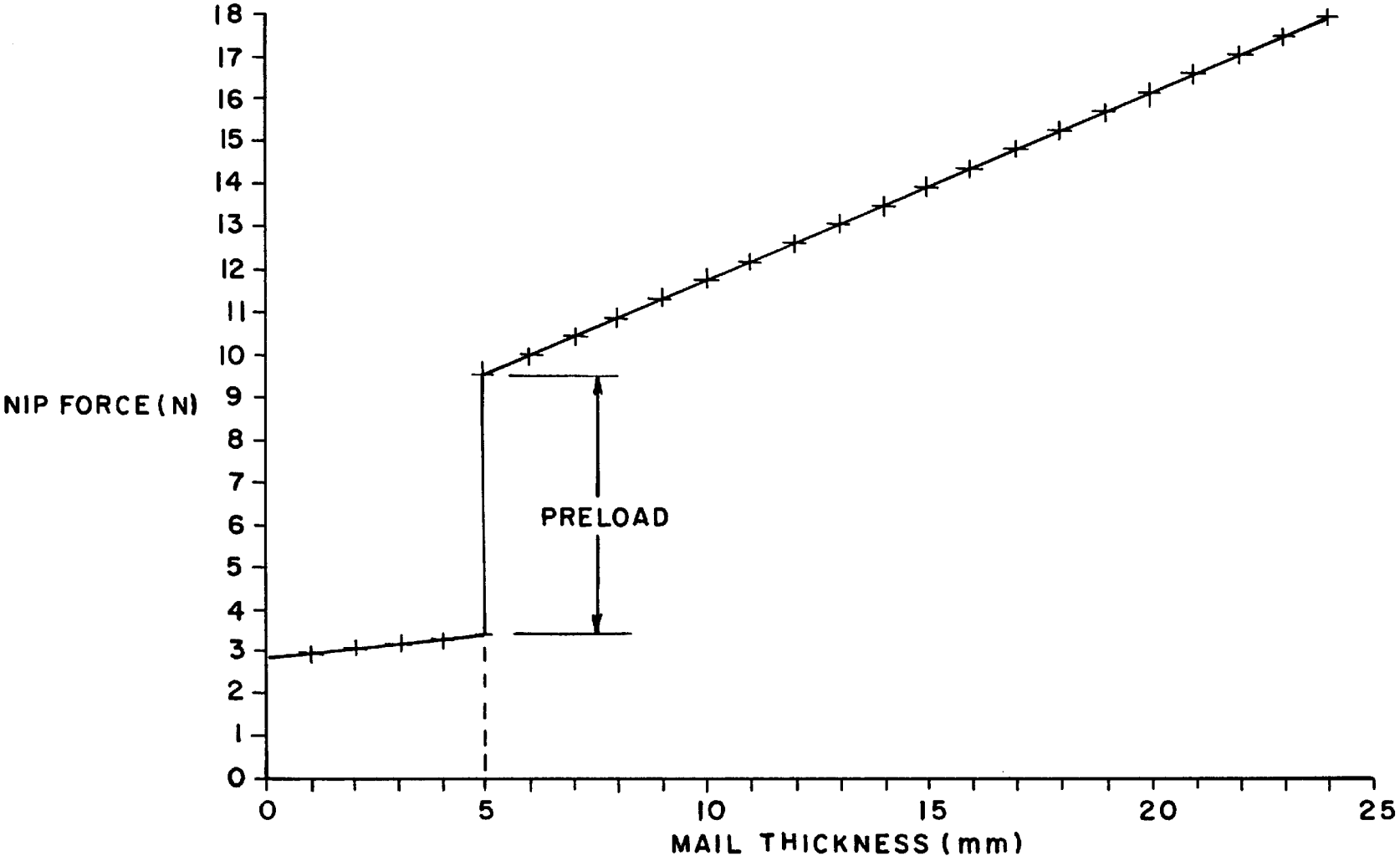
FIG. 9 is a force versus mailpiece thickness graph.

Returning specifically to FIG. 5, the use of the two biasing springs 187,189 provides an apparatus for automatically causing the reverse belt assembly 105 to exert a light nip force (preferably in a range of approximately 33.5 newtons) on the mailpieces passing thereby when the mailpiece is thin (a thickness less than approximately 5 millimeters. Alternatively when thicker mailpieces (greater than 5 millimeters) pass into nip 46 a nip force approximately greater than 10 newtons is applied. The reason for this two stage force profile is that if the higher normal forces are exerted on the thin mailpieces they have a tendency to buckle in the nip 46 and become damaged. This is particularly true for untabbed mailpieces. Alternatively, thicker mailpieces generally are heavier and require a greater nip force to ensure successful separation. The structure of FIG. 5 provides the two stage force profile as follows. Spring 187 is fixedly mounted at one end to arm 185 and at a second end to a post 241 fixedly connected to feed deck 109. Spring 187 is always in tension to bias the reverse belts 175 into contact with the mailpieces 3. As thicker mailpieces 3 pass into nip 46, bracket 171 is forced to rotate in the counterclockwise direction about shaft 183 extending the spring 187 further such that the biasing force increases but remains below 5 newtons. When a mailpiece of approximately 5 millimeters is in nip 46 however, bracket 171 is rotated to a point where spring 189 provides an additional biasing force in addition to that of spring 187 such that the combined biasing force of springs 187/189 is approximately 10 newtons. That is, spring 189 is fixedly connected at one end to a post 243 fixedly connected to deck 109. The other end of spring 189 is connected to a post 244 extending from a plate 245 mounted for slideable movement on post 243 and another post 246 fixedly connected to arm 185. Plate 245 has first and second slots 247, 249 through which respective posts 246 and 243 extend. When mailpieces less than 5 millimeters thick are in nip 46 spring 189 is preloaded at a force of approximately 6 newtons such that it pulls plate 245 via post 243 such that the left edge of slot 247 abuts against post 246. In this position, post 244 is free to float in slot 248 such that the preloaded force of spring 189 is not applied to arm 185. However, when a mailpiece thicker than 5 millimeters enters nip 46, arm 185 rotates until post 244 contacts the left edge of slot 248 at which point the preloaded force of spring 189 is immediately applied to arm 185 increasing the total biasing force from approximately 3,5 newtons to approximately 10 newtons. While a preferred embodiment has been described immediately above, it is clear that one possessing ordinary shill in the art based on the instant disclosure can design various force profiles through the proper selection of the springs 187/189. FIG. 9 shows the preferred force profile resulting from springs 187/189 as a function of mailpiece thickness. The large step up in the force curve shows that at 5 millimeters the preloaded spring 189 is applied.

Additional sensors 250 and 251 can also be added to improve mailpiece processing throughput. Sensor 250 can be used in lieu of sensor 63 to detect the trail edge of a mailpiece leaving separator 45 to identify when to restart feed belts 127 and sensor 251 will cause the nudger rollers to be driven if it does not detect the presence of mailpieces.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims. For example while the preferred embodiment is described in connection with a mail handling machine, any apparatus for handling mixed sizes of articles can utilize the principles of the invention. Additionally, while a separator utilizing belts is described it is known to use rollers in lieu of the belts.

What is claimed is:

1. In an apparatus having means for moving articles of mixed sizes from a stack of articles of mixed sizes along a feed path, a singulator apparatus comprising:

a feed deck;

forwardly driving means, connected to the feed deck, for contacting the articles along a first surface thereof and for moving the articles in a first direction along the feed path and over the feed deck;

a reverse driving mechanism, connected to the feed deck, for contacting the articles along a second surface thereof and for driving all but one of the articles in a second direction opposite to the first direction so that only one of the articles at a time is moved by the forwardly driving means in the first direction along the feed path and over the feed deck, the forwardly driving means and the reverse driving mechanism being connected to the feed deck relative to each other to define an article ingestion nip therebetween;

means for sensing if at least one of the articles is present in the article ingestion nip;

control means, operatively connected to the sensing means, for operating the moving means to move articles from the stack toward the article ingestion nip at times when the sensing means does not sense the presence of the at least one of the articles in the article ingestion nip and for preventing the moving means from moving articles from the stack toward the article ingestion nip at times when the sensing means senses the presence of the at least one of the articles in the article ingestion nip.

2. A singulator as recited in claim 1, further comprising first spring means for biasing the reverse driving mechanism into contact with the second surface to apply a first normal force thereto within a predetermined first force range and second spring means for biasing the reverse driving mechanism into contact with the second surface to apply a second normal force in addition to the first normal force to the second surface upon the occurrence of a predetermined condition.

3. A singulator as recited in claim 2, wherein the predetermined condition occurs when a mailpiece of a predetermined thickness enters the nip and the second normal force applied is approximately 6 newtons.

4. A singulator as recited in claim 1, wherein the moving means applies a feed force to the articles within a predetermined force range to move the articles toward the article ingestion nip and the control means includes means for determining if the sensing means does not detect the presence of the at least one of the articles within a predetermined time period and for causing the moving means to apply a feed force to the articles which is greater than any force value within the predetermined force range if the presence of the at least one of the articles is not sensed by the sensor means in the predetermined time period.

5. A singulator as recited in claim 4, further comprising an ingestion guide extending into the article ingestion nip, means for biasing the ingestion guide into contact with the second surface of the articles so that the ingestion guide provides stability to the articles thereby preventing them from curling up in the nip due to the action of the reverse driving mechanism and provides a normal force to the articles thereby increasing the feeding force applied by the forwardly driving means to the first surface.

6. A singulator as recited in claim 5, wherein the ingestion guide includes a stainless steel surface which contacts the second surface.

7. A singulator as recited in claim 6, further comprising take away means for accelerating the articles in the first direction away from the forwardly driving means, and wherein the forwardly driving means includes a first motor and a plurality of feed belts which contact the first surface and are driven into rotation by the first motor to move the articles in the first direction, the reverse driving mechanism includes a second motor and a plurality of reverse belts which contact the second surface and are driven into rotation by the second motor to drive the all but one of the articles in the second direction, and the take away means includes the second motor.

8. A singulator as recited in claim 7, further comprising take away sensing means, operatively connected to the control means, for sensing when articles are present at the take away means, and wherein at times when the take away sensing means senses the presence of articles the control means stops operation of the first motor thereby stopping rotation of the forwardly driving means to permit the take away means to accelerate articles from the nip without damage to the articles.

9. A singulator as recited in claim 8, wherein the forwardly driving means includes a drive shaft connected to the first motor, an overrunning clutch fixedly mounted to the drive shaft, and a pulley assembly mounted on the overrunning clutch and around which the plurality of feed belts are disposed, and wherein at times when the first motor drives the drive shaft the pulley assembly is driven via the overriding clutch to drive the plurality of feed belts into rotation and at times when the first motor is not energized the pulley assembly is free to rotate around the drive shaft as the take away means accelerate the articles out of the nip and away from the forwardly driving means.

10. A method for separating articles of mixed sizes from a stack of articles of mixed sizes being moved along a feed path, the method comprising the steps of:

utilizing a feed mechanism to feed articles of mixed sizes along the feed path;

causing a forward drive mechanism to contact the articles along a first surface thereof for moving the articles in a first direction along the feed path;

engaging a reverse driving mechanism with the articles along a second surface thereof for driving all but one of the articles in a second direction opposite to the first direction so that only one of the articles at a time is moved by the forwardly drive means in the first direction along the feed path, the forward drive mechanism and the reverse driving mechanism being positioned relative to each other to define an article ingestion nip therebetween;

sensing if at least one of the articles is present in the article ingestion nip;

operating the feeding mechanism for feeding articles from the stack toward the article ingestion nip at times when the presence of the at least one of the articles in the article ingestion nip is not sensed; and preventing the feeding mechanism from feeding articles from the stack toward the article ingestion nip at times when the sensing means senses the presence of the at least one of the articles in the article ingestion nip.

* * * * *